US009586235B2

(12) United States Patent
Zhao et al.

(10) Patent No.: US 9,586,235 B2
(45) Date of Patent: Mar. 7, 2017

(54) SYNCHRONOUS STATICALLY INDETERMINATE MESH-BEAM EXCITATION LARGE-SCALE VIBRATING SCREEN

(71) Applicant: CHINA UNIVERSITY OF MINING AND TECHNOLOGY, Jiangsu (CN)

(72) Inventors: Yuemin Zhao, Jiangsu (CN); Chengyong Zhang, Jiangsu (CN)

(73) Assignee: CHINA UNIVERSITY OF MINING AND TECHNOLOGY (CN)

( * ) Notice: Subject to any disclaimer, the term of this patent is extended or adjusted under 35 U.S.C. 154(b) by 0 days.

(21) Appl. No.: 14/432,239

(22) PCT Filed: May 17, 2013

(86) PCT No.: PCT/CN2013/075807

§ 371 (c)(1),
(2) Date: Mar. 30, 2015

(87) PCT Pub. No.: WO2014/176796

PCT Pub. Date: Nov. 6, 2014

(65) Prior Publication Data

US 2016/0038975 A1 Feb. 11, 2016

(30) Foreign Application Priority Data

Apr. 28, 2013 (CN) ..... 2013 1 0159605

(51) Int. Cl.
*B07B 1/42* (2006.01)
*B06B 1/16* (2006.01)
(Continued)

(52) U.S. Cl.
CPC ..... *B07B 1/42* (2013.01); *B06B 1/16* (2013.01); *B06B 1/0261* (2013.01); *B07B 1/343* (2013.01)

(58) Field of Classification Search
CPC .... B07B 1/40; B07B 1/42; B07B 1/46; B07B 1/28; B07B 1/34; B07B 1/343; B06B 1/16; B06B 1/0261
(Continued)

(56) References Cited

U.S. PATENT DOCUMENTS 6,003,682 A * 12/1999 Bielagus ..... B07B 1/12 209/394
8,074,805 B2 * 12/2011 Zhao ..... B07B 1/42 209/236
2014/0166546 A1 * 6/2014 Kinnunen ..... B07B 1/4627 209/355

FOREIGN PATENT DOCUMENTS

CN 2531884 Y 1/2003
CN 200995189 Y 12/2007
(Continued)

OTHER PUBLICATIONS

International Search Report issued from the State Intellectual Property Office of the P.R. China dated Dec. 26, 2013; International Application No. PCT/CN2013/075807.

*Primary Examiner* — Joseph C Rodriguez
*Assistant Examiner* — Kalyanavenkateshware Kumar
(74) *Attorney, Agent, or Firm* — Bracewell LLP; Brad Y. Chin

(57) ABSTRACT

Embodiments of the invention provide a synchronous statically indeterminate mesh-beam excitation large-scale vibrating screen, including a screen box, a support spring group, a spring base, a motor mount, a tire coupling, and a motor, wherein, a statically indeterminate mesh-beam excitation body is arranged on the screen box, and the statically indeterminate mesh-beam excitation body has at least one synchronous eccentric block vibration exciter group and two self-synchronous eccentric block vibration exciter groups in it; each self-synchronous eccentric block vibration exciter
(Continued)

group includes a self-synchronous transmission shaft fixed to the side plates of the screen box via a bearing chock, and self-synchronous eccentric blocks fixed to the side plates of the screen box in symmetry are arranged on the self-synchronous transmission shaft; the self-synchronous transmission shaft of the self-synchronous eccentric block vibration exciter group at the side of the motor is connected with a reducer via the tire coupling, and the reducer is connected to the motor via a transmission belt.

2 Claims, 3 Drawing Sheets

(51) Int. Cl.
*B06B 1/02* (2006.01)
*B07B 1/34* (2006.01)

(58) Field of Classification Search
USPC ..... 209/309, 322, 364, 365.1, 409
See application file for complete search history.

(56) References Cited

FOREIGN PATENT DOCUMENTS

| | | | |
|---|---|---|---|
| CN | 200995190 | Y | 12/2007 |
| JP | 2002-176 | A | 1/2002 |

* cited by examiner

SYNCHRONOUS STATICALLY INDETERMINATE MESH-BEAM EXCITATION LARGE-SCALE VIBRATING SCREEN

CROSS REFERENCE TO RELATED APPLICATION

This application claims the benefit of and priority to PCT/CN2013/075807 filed on May 17, 2013, entitled (translation), "LARGE SYNCHRONIZING STATICALLY INDETERMINATE BEAM EXCITATION VIBRATING SCREEN," which claims the benefit of and priority to Chinese Patent Application No. CN 201310159605.0 filed on Apr. 28, 2013, entitled (translation), "LARGE SYNCHRONOUS HYPERSTATIC NET-BEAM VIBRATING SCREEN," both of which are hereby incorporated by reference in their entirety into this application.

BACKGROUND

Field of the Invention

Embodiments of the invention relate to a synchronous statically indeterminate mesh-beam excitation large-scale vibrating screen, which is especially suitable for depth grading, dewatering, medium drainage and desliming of wet and sticky raw coal, and grading of other materials.

Description of the Related Art

Vibrating screens are the major equipment in coal preparation plants, and the quantity of the vibrating screens is large, the norms of the vibrating screens are various, even the accidents related to the vibrating screens are frequent.

Large-scale vibration grading screens are the key equipment for construction of new large-scale coal preparation plants, and key equipment for technical renovation of existing coal preparation plants. The reliability of these screens has direct influence on the normal production and economic benefit of the coal preparation plants. Up to now, there is no great breakthrough in the research and development of the structure of large-scale vibrating screens yet. Large-scale vibrating screens produced by domestic manufacturers cannot meet the actual demands of production in coal mines and coal preparation plants in terms of reliability and service life. Essentially, large-scale vibrating screens demanded in China depend on import.

In terms of the structural form and design techniques, all large-scale vibrating screens imported and assimilated technically in China employ gear-driven forcibly synchronized vibration exciters, in which the bearing beam is a single supporting bearer, and has a massive structure in order to withstand the impact load caused by high excitation force. When the section width of the screen frame is greater than 3 m, the structural dimensions and weight of the bearing beam will be increased greatly, and the vibration mass of the screen body will be increased accordingly. Consequently, it is difficult to process and assemble the bearing beam; in addition, the structural stiffness of a vibrating screen in such a structure is not strengthened, owing to the effect of concentrated load. Therefore, failures often occur during the operation of such vibrating screens. For example, the hollow beams may be fractured and the side plates may be cracked. Hence, not only the production efficiency is degraded, but also the service life of the vibrating screen is shortened. That is also a critical factor to limit the section width of screen body of vibrating screens to be larger and breakthroughs in the structural parameters for long. Since the screen size cannot be increased, more vibrating screen equipment have to be used to meet the demand of production. Consequently, the construction cost and production management cost are increased.

At present, all large-scale and extra-large-scale vibrating screens demanded in China depend on import. Over the years, how to solve the key problems in technology, research and develop large-scale vibrating screens with high reliability, and accomplish technical localization of large-scale vibrating screens have been urgent tasks in the development of coal preparation process technical level and large-scale industrial production.

SUMMARY

To overcome the drawbacks in the conventional art, embodiments of the invention provide a synchronous statically indeterminate mesh-beam excitation large-scale vibrating screen, which has a compact structure, reasonable stress distribution, high stiffness, high reliability, and low impact force on the gears and good using effect.

Embodiments of the invention provide a synchronous statically indeterminate mesh-beam excitation large-scale vibrating screen, which includes a screen box, a support spring group and a spring base that support under the screen box, a motor mount and a tire coupling arranged on one side of the screen box, a motor provided on the motor mount, and a statically indeterminate mesh-beam excitation body arranged on the screen box. According to at least one embodiment, the statically indeterminate mesh-beam excitation body is a containing body including a plurality of mesh-beam tubes connected via statically determinate plates and a statically indeterminate plate. The statically indeterminate mesh-beam excitation body has at least one synchronous eccentric block vibration exciter group and two self-synchronous eccentric block vibration exciter groups in it. The synchronous eccentric block vibration exciter group is arranged in the middle part of the statically indeterminate mesh-beam excitation body, and the self-synchronous eccentric block vibration exciter groups are arranged at the two sides of the statically indeterminate mesh-beam excitation body. According to at least one embodiment, the synchronous eccentric block vibration exciter group includes a statically indeterminate box, two synchronous gears engaged with each other in the vertical direction are arranged in the statically indeterminate box, where the two synchronous gears are fixed respectively to a bearing chock of the statically indeterminate box via synchronous transmission shafts, and synchronous eccentric blocks fixed to the synchronous transmission shafts are arranged at the two sides of the two synchronous gears respectively. According to at least one embodiment, the self-synchronous eccentric block vibration exciter group includes a self-synchronous transmission shaft fixed to the side plates of the screen box via the bearing chock, and self-synchronous eccentric blocks fixed to the side plates of the screen box in symmetry are arranged on the self-synchronous transmission shaft. According to at least one embodiment, the two ends of the synchronous transmission shaft for the two synchronous gears are connected respectively with the self-synchronous transmission shaft for the self-synchronous eccentric blocks fixed respectively to the two side plates of the screen box via universal coupling. The self-synchronous transmission shaft of the self-synchronous eccentric block vibration exciter group at the side of the motor is connected with a reducer via the tire coupling, and the reducer is connected to the motor via a transmission belt.

The statically indeterminate box has a strip shape, and is symmetric in the vertical direction, wherein, an upper end and a lower end are connected with a retaining plate that is fixed together with the statically indeterminate plate.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

Figure 1:
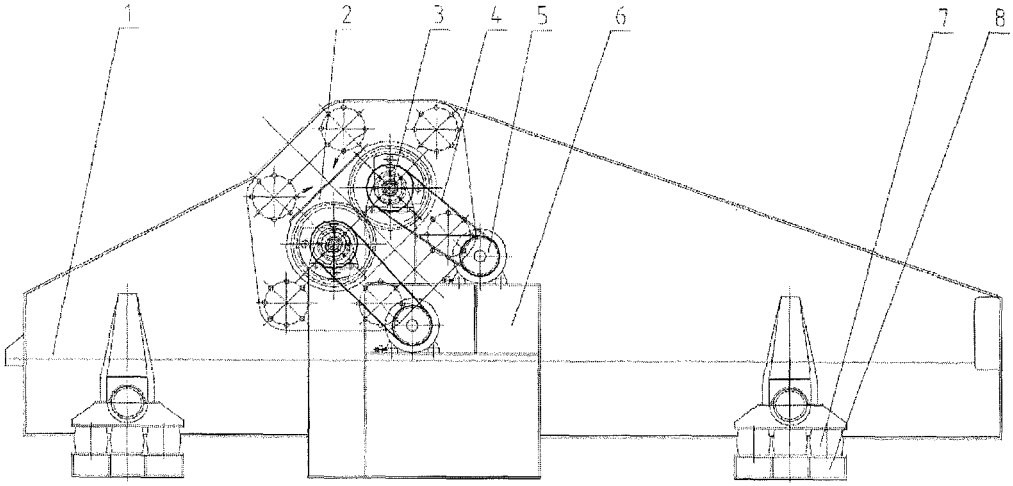
FIG. 1 is a front view of the structure of an embodiment of the invention.

Among the figures: 1—screen box, 2—statically indeterminate mesh-beam excitation body, 3—reducer, 4—transmission belt, 5—motor, 6—motor mount, 7—support spring group, 8—spring base, 9—tire coupling, 10—discharge port, 11—bearing beam, 12—reinforcing beam, 13—rear apron, 14—screen board, 15—statically indeterminate box, 16—mesh-beam tube, 17—synchronous gear, 18—statically determinate plate, 19—self-synchronous eccentric block vibration exciter group, 20—universal coupling, 21—statically indeterminate plate, 22—synchronous eccentric block vibration exciter group.

DETAILED DESCRIPTION

Advantages and features of the invention and methods of accomplishing the same will be apparent by referring to embodiments described below in detail in connection with the accompanying drawings. However, the invention is not limited to the embodiments disclosed below and may be implemented in various different forms. The embodiments are provided only for completing the disclosure of the invention and for fully representing the scope of the invention to those skilled in the art.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. According to at least one embodiment, the dimensions of some of the elements in the figures may be exaggerated relative to other elements to help improve understanding of embodiments of the invention. Like reference numerals refer to like elements throughout the specification.

With the high-stiffness statically indeterminate beam containing body according to various embodiments of the invention, the structural stiffness of the screen box is strengthened, and the reliability and service life of the entire screen body are greatly improved. With a synchronous statically indeterminate structure that employs two motors for opposite driving, the engagement force generated in forced synchronization in the conventional gear engagement structure is changed, so that the high impact force (i.e., usually tens of tons or higher) borne on a single driving gear during engagement is changed to chasing structural force driving oppositely. The chasing structural force depends on the motor slip of the two motors. Theoretically, if the motor slip of the two motors is zero, no engagement force will be produced in the gear structure, and only a synchronization effect will be produced. Actually, motor slip always exists between two motors, owing to manufacturing process and raw material factors. Among conventional motors, usually the motor slip resulting from manufacturing errors is as low as several turns. For example, in a case of two six-pole motors (960 rpm) with 6 rpm motor slip, theoretically the chasing force created during gear engagement is only $1/160$ of the engagement force of a single gear. Thus, the stress condition of the gears and the lubrication condition during operation are completely changed. The structural force resulting from chasing depends on the motor slip between two motors; thus, the out-of-sync deviation resulted from a variety of factors in a combination of self-synchronous vibration exciters is completely changed, and the combined stress damage of bending and torsional stress resulting from out-of-sync deviation to the screen body is avoided, and the adverse effect of deviated vibrating direction angle to screening, dewatering, medium drainage, and desliming processes is avoided. According to at least one embodiment, since the high impact force created during gear engagement is converted into a structural force resulted from synchromesh and chasing (i.e., the structural force resulted from chasing depends on the meshing error between the gears, speed difference between the motors, and manufacturing error), the bearing capacity and module of the gears can be decreased in the design and manufacturing process, the running accuracy and manufacturing accuracy can be improved greatly, and the movement noise incurred by impact load during gear engagement can be decreased. Fluid lubrication, grease lubrication and mixed lubrication can be used for the structure, depending on the operating conditions of the vibrating screen. Since a synchronous statically indeterminate mesh-beam excitation composite structure according to various embodiments of the invention is used, the structure of the screen body is more compact, and the force distribution is more reasonable. The synchronous statically indeterminate mesh-beam excitation composite structure is applicable to screens with single channel, double channels, and multiple channels. With that structural form, the bending and torsional stress resistance performance of the screen body is improved, the structural stiffness is increased, and the vibration mass of the vibrating screen is deceased. The stress condition and lubrication condition of gear engagement are changed owing to the particularity of the structure, the synchronization performance of the synchronous screen is improved, the reliability of the screen is greatly improved, and the overall mechanical properties of the entire machine are improved. Hence, the design and manufacturing conditions for large-scale and extra-large-scale vibrating screens can be changed, and the production demand in large-scale coal mines and coal preparation plants in China can be met. Embodiments of the invention can be widely used in coal mining, metallurgical, chemical, and environmental protection field, etc.

Hereinafter, various embodiments of the invention will be described in detail with reference to the accompanying drawings.

Figure 2:
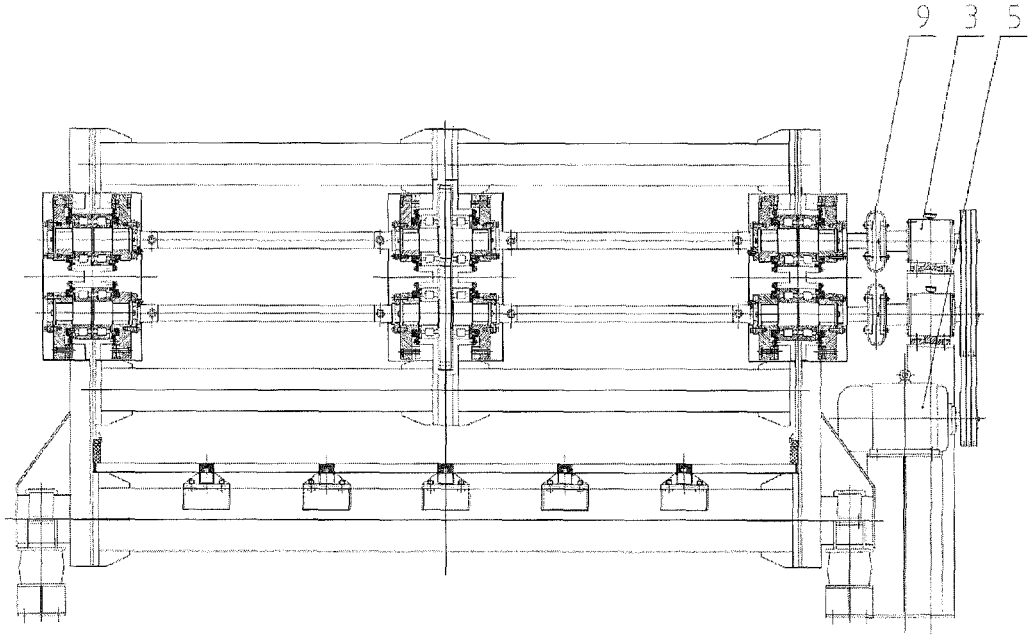
FIG. 2 is a left view of the structure of an embodiment of the invention.

As shown in FIG. 1 and FIG. 2, the synchronous statically indeterminate mesh-beam excitation large-scale vibrating screen, according to at least one embodiment of the invention, includes a screen box 1, a statically indeterminate mesh-beam excitation body 2, a reducer 3, a transmission belt 4, a motor 5, a motor mount 6, a support spring group 7, a spring base 8, a tire coupling 9, a discharge port 10, a bearing beam 11, a reinforcing beam 12, a rear apron 13, a screen board 14, mesh-beam tubes 16, a statically determinate plate 18, a self-synchronous eccentric block vibration exciter group 19, an universal coupling 20, and a synchronous eccentric block vibration exciter group 22.

According to at least one embodiment, the mesh-beam tubes 16, the statically determinate plate 18, the self-synchronous eccentric block vibration exciter group 19, the universal coupling 20, the statically indeterminate plate 21, and the synchronous eccentric block vibration exciter group 22 constitute a synchronous statically indeterminate mesh-beam excitation body 2, i.e., 3 groups of vibration exciters arranged in two strings and a plurality of mesh-beam tubes 16 are connected in combination into the synchronous statically indeterminate mesh-beam excitation body 2.

Figure 5:
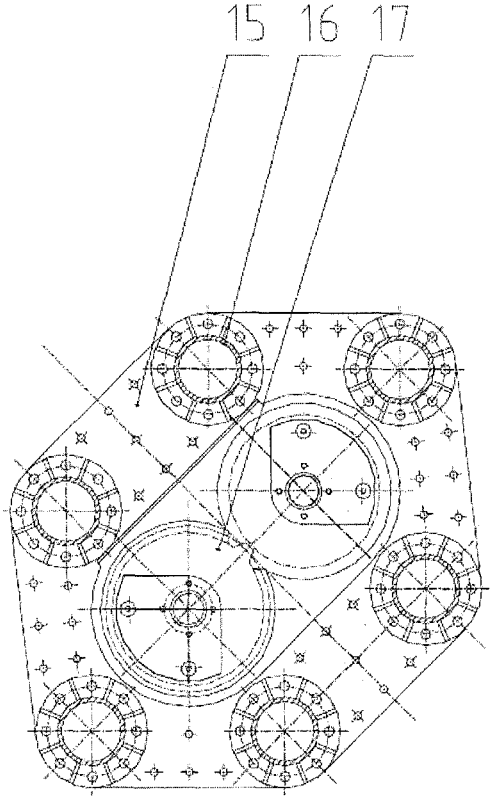
FIG. 5 is a front view of the statically indeterminate mesh-beam excitation structure in an embodiment of the invention.
Figure 6:
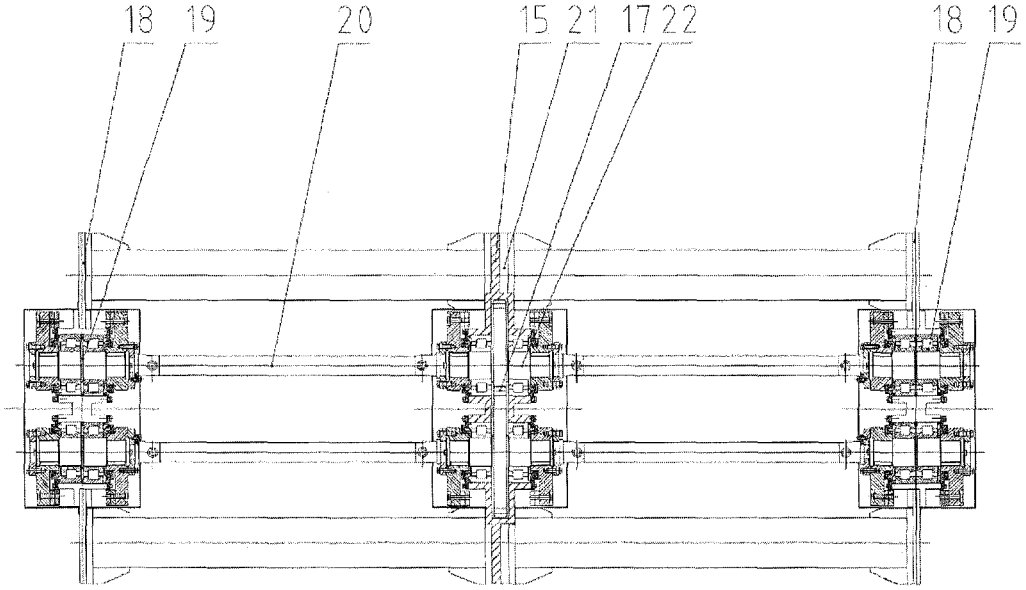
FIG. 6 is a side view of the statically indeterminate mesh-beam excitation structure in an embodiment of the invention.

According to at least one embodiment, the discharge port 10, the rear apron 13, and the screen board 14 of the screen box 1 are connected with each component and the sides of the screen box 1 into an entire assembly by high tensile reamed bolts and ring-grooved rivets, and thereby constitute an enclosed high-stiffness containing body. The support spring group 7 and the spring base 8 support under the screen box 1, the motor mount 6 and the tire coupling 9 are arranged on one side of the screen box 1, the motor 5 is provided on the motor mount 6; the screen box 1 is provided with a statically indeterminate mesh-beam excitation body 2, which is a containing body made up of a plurality of mesh-beam tubes 16 connected via two statically determinate plates 18 and a statically indeterminate plate 21, as shown in FIG. 5 and FIG. 6.

According to at least one embodiment, the statically indeterminate mesh-beam excitation body 2 has at least one synchronous eccentric block vibration exciter group 22 and two self-synchronous eccentric block vibration exciter groups 19 arranged in it, wherein, the synchronous eccentric block vibration exciter group 22 is arranged in a middle part of the statically indeterminate mesh-beam excitation body 2, while the self-synchronous eccentric block vibration exciter groups 19 are arranged at the two sides of the statically indeterminate mesh-beam excitation body 2.

According to at least one embodiment, the synchronous eccentric block vibration exciter group 22 includes a statically indeterminate box 15 arranged in the middle part of the statically indeterminate mesh-beam excitation body 2, the statically indeterminate box 15 having a strip shape and being symmetric in the vertical direction, with an upper end and a lower end connected with a retaining plate fixed together with the statically indeterminate plate 21.

According to at least one embodiment, the statically indeterminate plate 21 is fixed to the middle part of the mesh-beam tubes 16, and is connected with the statically determinate plate 18 via the mesh-beam tubes 16, to form a high-stiffness containing excitation body. Two synchronous gears 17 engaged with each other in the vertical direction are arranged in the statically indeterminate box 15, and are fixed respectively to a bearing chock of the statically indeterminate box 15 via a synchronous transmission shaft, and synchronous eccentric blocks fixed to the synchronous transmission shaft are arranged respectively at the two sides of the two synchronous gears 17; the self-synchronous eccentric block vibration exciter group 19 including a self-synchronous transmission shaft fixed to the side plates of the screen box 1 via the bearing chock, and self-synchronous eccentric blocks fixed to the side plates of the screen box 1 in symmetry are arranged on the self-synchronous transmission shaft.

According to at least one embodiment, the two ends of the synchronous transmission shaft for the two synchronous gears 17 are connected via a universal coupling 20 respectively with the self-synchronous transmission shafts for the self-synchronous eccentric blocks fixed to the two side plates of the screen box 1, respectively.

According to at least one embodiment, the structure of the self-synchronous eccentric block vibration exciter group 19 is almost identical to that of the synchronous eccentric block vibration exciter group 22, except that the self-synchronous eccentric block vibration exciter group 19 does not have any synchronous gears 17, and the said self-synchronous eccentric block vibration exciter group 19 excites synchronously with the synchronous eccentric block vibration exciter group 22 in a state that synchronized forcibly by the synchronous eccentric block vibration exciter group 22. The self-synchronous transmission shaft of the self-synchronous eccentric block vibration exciter group 19 at the side of the motor 5 is connected with the reducer 3 via the tire coupling 9, and the reducer 3 is connected to the motor 5 via the transmission belt 4. The motor 5 drives the reducer 3 via the transmission belt, and the reducer 3 drives the synchronous eccentric block vibration exciter group 22 to achieve synchronization, where the synchronous eccentric block vibration exciter group 22 is synchronized forcibly via the synchronous gears 17.

According to at least one embodiment, the synchronous gears 17 supported on the statically indeterminate mesh-beam excitation body 2 engage with the synchronous eccentric block vibration exciter group 22 and the synchronous eccentric block vibration exciter group 22 supported on the statically indeterminate plate 21 and the sides of the screen box 1 are connected in series via the universal coupling 20, to implement synchronous body excitation. According to at least one embodiment, the screen board 14 adopts embedded a composite screen board, a slot screen board, or a perforated screen board, and different screen boards with appropriate mesh size in appropriate form can be used to implement material grading, dewatering, medium drainage, and desliming at different size grades.

Figure 3:
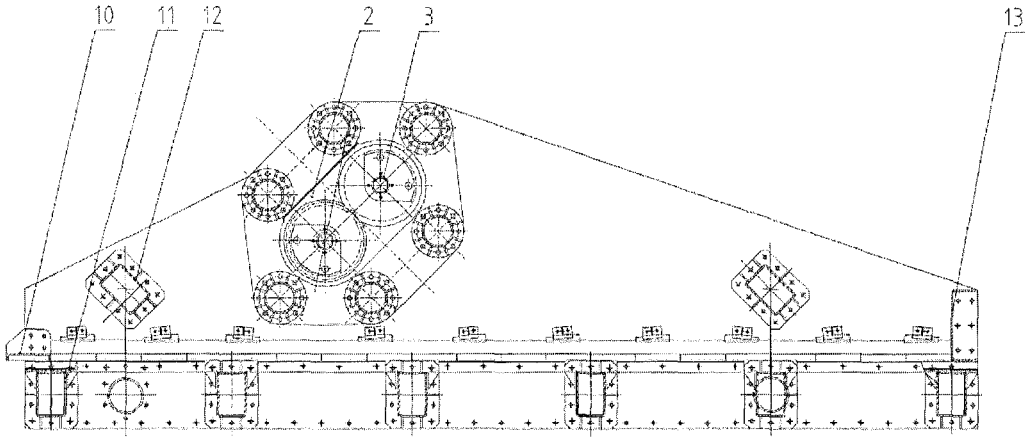
FIG. 3 is a schematic structural diagram of the screen box of the large-scale vibrating screen in a statically indeterminate mesh-beam excitation structure in an embodiment of the invention.
Figure 4:
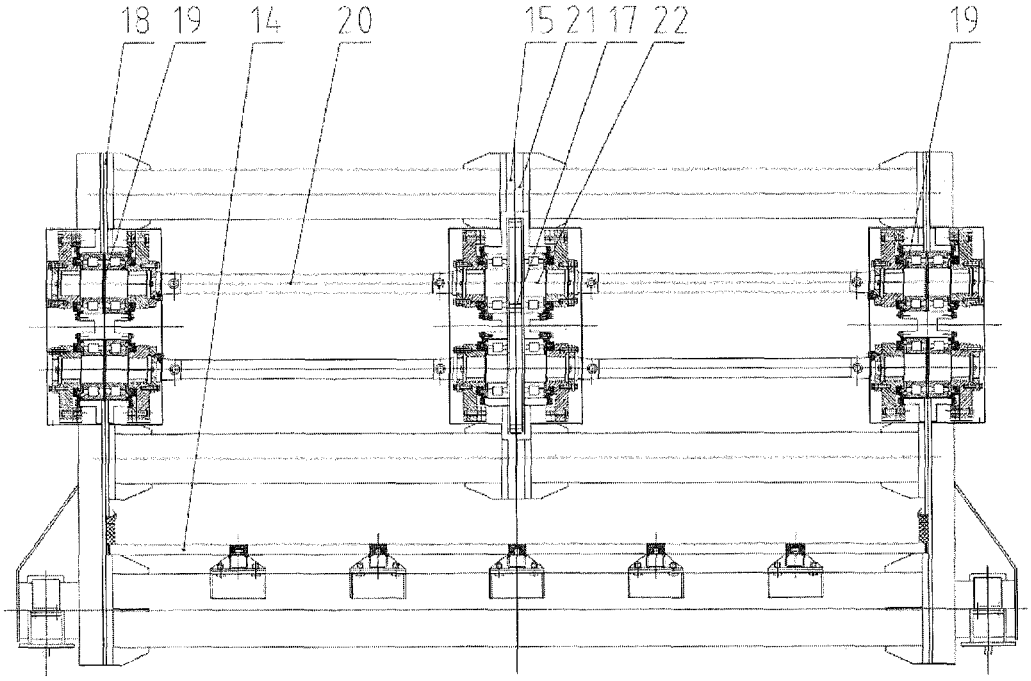
FIG. 4 is a left view of the screen box of the large-scale vibrating screen in a statically indeterminate mesh-beam excitation structure in an embodiment of the invention.

As shown in FIG. 3 and FIG. 4, the statically indeterminate box 15, mesh-beam tubes 16, synchronous gears 17, statically determinate plate 18, two sets of self-synchronous eccentric block vibration exciter groups 19, the universal coupling 20, the statically indeterminate plate 21, and a synchronous eccentric block vibration exciter group 22 constitute a screen body with high-stiffness structure. The two sets of self-synchronous eccentric block vibration exciter groups 19 connected to the two sides of the screen box 1 are block eccentric vibration exciters in a statically determinate self-synchronous structure, and the synchronous eccentric block vibration exciter group 22 connected to the middle part is block eccentric vibration exciters in a statically indeterminate structure that are synchronized forcibly by gear engagement. The synchronous statically indeterminate mesh-beam excitation body 2 is the key component of the high-stiffness containing body, and the structural stiffness of the screen body is ensured by the structural reliability, machining accuracy, and assembly techniques of the components. The overall stiffness is decided by the structural combination. In the beam system, according to at least one embodiment of the invention, composed of mesh beams, after being assembled and welded together, stress relieving treatment must be made to each individual mesh-beam tube 16 according to process demand. For the statically indeterminate plate 21 and statically determinate plate 19, after blanking neatly, each working surface must be cut smoothly. After the mesh-beam body, the reinforcing beam, and the bearing beam are welded together, its axial dimension shall be controlled within the tolerance range of the same nominal dimension. All structural parts connected to the sides of the screen body shall adopt high tensile reamed bolts and ring-grooved rivets, and all holes on the sides of the screen body shall be matched by single reamer.

Terms used herein are provided to explain embodiments, not limiting the invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Embodiments of the invention may suitably comprise, consist or consist essentially of the elements disclosed and may be practiced in the absence of an element not disclosed. According to at least one embodiment, it can be recognized by those skilled in the art that certain steps can be combined into a single step.

The terms and words used in the specification and claims should not be interpreted as being limited to typical meanings or dictionary definitions, but should be interpreted as having meanings and concepts relevant to the technical scope of the invention based on the rule according to which an inventor can appropriately define the concept of the term to describe the best method he or she knows for carrying out the invention.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, it will be understood that unless a term such as 'directly' is not used in a connection, coupling, or disposition relationship between one component and another component, one component may be 'directly connected to', 'directly coupled to' or 'directly disposed to' another element or be connected to, coupled to, or disposed to another element, having the other element intervening therebetween.

As used herein, the terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical or non-electrical manner. Objects described herein as being "adjacent to" each other may be in physical contact with each other, in close proximity to each other, or in the same general region or area as each other, as appropriate for the context in which the phrase is used. Occurrences of the phrase "according to an embodiment" herein do not necessarily all refer to the same embodiment.

Ranges may be expressed herein as from about one particular value, and/or to about another particular value. When such a range is expressed, it is to be understood that another embodiment is from the one particular value and/or to the other particular value, along with all combinations within said range.

Although the invention has been described in detail, it should be understood that various changes, substitutions, and alterations can be made hereupon without departing from the principle and scope of the invention. Accordingly, the scope of the invention should be determined by the following claims and their appropriate legal equivalents.

The invention claimed is:

1. A synchronous statically indeterminate mesh-beam excitation large-scale vibrating screen, comprising:

a screen box;

a support spring group and a spring base that support under the screen box;

a motor mount and a tire coupling arranged on one side of the screen box;

a motor provided on the motor mount; and a statically indeterminate mesh-beam excitation body arranged on the screen box, the statically indeterminate mesh-beam excitation body being a containing body comprising a plurality of mesh-beam tubes connected via statically determinate plates and a statically indeterminate plate, wherein the statically intermediate mesh-beam excitation body comprises at least one synchronous eccentric block vibration exciter group and two self-synchronous eccentric block vibration exciter groups in it, wherein the synchronous eccentric block vibration exciter group is arranged in a middle part of the statically indeterminate mesh-beam excitation body, and the self-synchronous eccentric block vibration exciter groups are arranged at two sides of the statically indeterminate mesh-beam excitation body, wherein the synchronous eccentric block vibration exciter group comprises a statically indeterminate box, two synchronous gears engaged with each other in vertical direction are arranged in the statically indeterminate box, the two synchronous gears being fixed respectively to the statically indeterminate box via a synchronous transmission shaft, and synchronous eccentric blocks fixed to the synchronous transmission shaft are arranged at two sides of the two synchronous gears, respectively, wherein the two synchronous gears engage with the synchronous eccentric block vibration exciter group, and the synchronous eccentric block vibration exciter group supported on the statically indeterminate plate and sides of the screen box are connected in series via a universal coupling, so as to implement synchronous body excitation, wherein each of the self-synchronous eccentric block vibration exciter groups (19) comprises a self-synchronous transmission shaft fixed to side plates of the screen box, and self-synchronous eccentric blocks fixed to the side plates of the screen box in symmetry are arranged on the self-synchronous transmission shaft wherein two ends of the synchronous transmission shaft for the two synchronous gears are connected via the universal coupling respectively with the self-synchronous transmission shaft for the self-synchronous eccentric blocks fixed respectively to the two side plates of the screen box, wherein the self-synchronous transmission shaft of the self-synchronous eccentric block vibration exciter group at a side of the motor is connected with a reducer via the tire coupling, the structure of the self-synchronous eccentric block vibration exciter group being almost identical to that of the synchronous eccentric block vibration exciter group with the exception that the self-synchronous eccentric block vibration exciter group does not have any synchronous gears, and the said self-synchronous eccentric block vibration exciter group being configured to excite synchronously with the synchronous eccentric block vibration exciter group in a state that is synchronized forcibly by the synchronous eccentric block vibration exciter group, the reducer being connected to the motor via a transmission belt, the motor being configured to drive the reducer via the transmission belt, and the reducer being configured to drive the synchronous eccentric block vibration exciter group to achieve synchronization.

2. The synchronous statically indeterminate mesh-beam excitation large-scale vibrating screen according to claim 1, wherein the statically indeterminate box has a strip shape and is symmetric in the vertical direction, with an upper end and a lower end connected with a retaining plate fixed together with the statically indeterminate plate.

* * * * *